US009120142B2

(12) United States Patent
Matt et al.

(10) Patent No.: US 9,120,142 B2
(45) Date of Patent: Sep. 1, 2015

(54) METHOD FOR PRODUCING A MOLDED PART PROVIDED WITH A THROUGH-HOLE

(75) Inventors: Andreas Matt, Murg (DE); Mihai Vulcan, Hofstetten (CH)

(73) Assignee: Hatebur Umformmaschinen AG, Reinach (CH)

( * ) Notice: Subject to any disclaimer, the term of this patent is extended or adjusted under 35 U.S.C. 154(b) by 342 days.

(21) Appl. No.: 13/122,648

(22) PCT Filed: Oct. 2, 2009

(86) PCT No.: PCT/CH2009/000316

§ 371 (c)(1),
(2), (4) Date: Apr. 18, 2011

(87) PCT Pub. No.: WO2010/040238

PCT Pub. Date: Apr. 15, 2010

(65) Prior Publication Data

US 2011/0193257 A1 Aug. 11, 2011

(30) Foreign Application Priority Data

Oct. 10, 2008 (CH) ..... 1607/08

(51) Int. Cl.

| | |
|---|---|
| ***B28B 1/48*** | (2006.01) |
| ***B21K 1/76*** | (2006.01) |
| ***B21K 1/04*** | (2006.01) |

(52) U.S. Cl.

CPC .. *B21K 1/761* (2013.01); *B21K 1/04* (2013.01)

(58) Field of Classification Search

USPC ..... 264/40.5–40.7, 46.8, 645, 663, 77, 154, 264/155, 156, 153, 239, 255, 294, 297.2, 264/320

See application file for complete search history.

(56) References Cited

U.S. PATENT DOCUMENTS

| | | | | |
|---|---|---|---|---|
| 4,435,973 | A * | 3/1984 | Nakazawa et al. | 72/327 |
| 4,932,251 | A * | 6/1990 | Okada et al. | 72/334 |

FOREIGN PATENT DOCUMENTS

| | | | |
|---|---|---|---|
| DE | 3147897 | A1 | 6/1983 |
| EP | 0537034 | A1 | 4/1993 |
| FR | 661584 | | 7/1929 |
| JP | 49086250 | | 8/1974 |
| JP | 5870935 | A | 4/1983 |
| JP | 5950945 | A | 3/1984 |
| JP | 6284849 | A | 4/1987 |
| JP | 64022434 | | 1/1989 |
| JP | 3062637 | | 7/1999 |
| WO | 2008111119 | A1 | 9/2008 |

OTHER PUBLICATIONS

F. Otto, etc., "Fine Blanking With or Without Tooth Compression Ring", "Mould Technology", Issue 02, pp. 67-70, Apr. 1988.

* cited by examiner

*Primary Examiner* — Stella Yi
(74) *Attorney, Agent, or Firm* — The Webb Law Firm

(57) ABSTRACT

To produce a molded part with a through-hole, a rod-shaped blank is pushed through a guide into a cavity and fixed in place. The end region of the blank is compressed and reshaped into a disk. A disk core having the same cross-sectional shape as the blank is ejected out of the disk using a punch and pushed into the guide and moved back together with the unshaped part of the blank. The disk is severed from the disk core and the molded part is removed from the cavity. During the penetration step, the disk present in the cavity is subjected to an axial pressure in the disk core ejection direction and the blank is subjected to an axial counter-force opposite to the disk core ejection direction.

13 Claims, 4 Drawing Sheets

METHOD FOR PRODUCING A MOLDED PART PROVIDED WITH A THROUGH-HOLE

BACKGROUND OF THE INVENTION

1. Field of the Invention

The invention relates to a method for producing a moulded part provided with a through-hole as well as a device for performing the method of producing a moulded part provided with a through-hole.

2. Description of Related Art

Such a method is known for example from DE 31 47 897 A1. According to this document, the mass production of identical annular metallic parts takes place proceeding from a metallic, rod-shaped blank by the compression and thereby effected deformation of an end region of the blank to form a disc and by subsequent axial puncturing of the disc by means of a punch having the same cross-sectional shape as the (uncompressed) blank and severing of the disc core punctured by the punch from the disc. The disc core in one piece with the uncompressed blank segment forms together with the latter the starting point for a further process cycle until such time as the remaining part of the blank is no longer sufficient for the formation of further-moulded parts and is lost as waste.

During the puncturing of the disc core, an undesired fracture surface with cracks and at best burrs, which may require reworking of the moulded parts, is formed at the peripheral edge of the through-hole thereby produced in the disc on account of the shearing and tensile stresses taking effect.

The problem underlying the invention therefore is to improve a method of the type mentioned at the outset in such a way that the moulded parts thereby produced do not require reworking or at least greatly reduced reworking. In particular, the moulded parts should not exhibit any substantial fractures, burrs or other deformations in the region of their produced through-hole.

This problem is solved by the method according to an embodiment of the invention and the device according to an embodiment of the invention. Particularly advantageous developments and embodiments of the invention are described herein.

"Rod material" is understood in the present connection to mean any form of material with a pronounced longitudinal extension and an arbitrary cross-section that is constant over the longitudinal extension. In particular, rods, bars and wires having any dimensions fall under this definition. Circular cross-sections are the rule, but the invention is not limited thereto. The term "rod-shaped" is to be understood similarly. "Disc" is to be understood in the present connection as any body shape widened in the cross-sectional dimensions compared to the blank. Flat discs with, in particular, a circular external contour are the rule, but the invention is not limited thereto.

SUMMARY OF THE INVENTION

An embodiment of the present invention may include the following: In a method for producing a moulded part provided with a through-hole, a rod-shaped blank is advanced by a defined length in its longitudinal direction, in a advancing step, through a guide having the same cross-sectional shape as the blank into a die and then held fast, the inner peripheral wall of said die establishing the external periphery of the moulded part to be produced. In at least one reshaping step, the end region of the blank located outside the guide on the die side is axially compressed using a swage and thereby reshaped to form a disc limited at its periphery by the die. In a penetration step, the disc located in the die is penetrated by means of a punch coaxial with the guide and having the same cross-sectional shape as the guide and a disc core in one piece with the undeformed part of the blank and having the same cross-sectional shape is ejected from the disc, pushed into the guide and, together with the undeformed part of the blank located in the guide, moved back opposite to the advancing direction of the blank. In a severing step, the punctured disc is severed from the disc core and, in a removal step, the finished moulded part is finally removed from the die. According to another embodiment of the invention, during the penetration step, the disc located in the die is subjected, by a sleeve-shaped hold-down element of the swage that is mobile relative to the punch and surrounding the punch, to an axial pressing force in the disc core ejection direction and the blank is subjected to an axial counter-force opposite to the disc core ejection direction, wherein the external contour of the hold-down element essentially corresponds to the internal contour of the die.

Via the axial pressing force and the axial counter-force, with suitable rating thereof, a stress state is produced which prevents significant fractures, burrs or such deformations at the peripheral edge of the through-hole in the disc produced during the penetration.

Preferably also during the severing step, i.e. when the disc core ejected from the disc located in the die is severed from the disc, an axial pressing force is exerted in the disc core ejection direction on the disc located in the die.

To produce the axial pressing force preferably a hold-down element is used, which surrounds the punch of the swage and is relative displaceable. Such a hold-down element is comparatively easy to realise.

The blank is preferably held fast by means of a clamping arrangement engaging at its periphery during the reshaping step, the penetration step and the severing step, The counter-force is preferably introduced into the blank with the aid of the clamping arrangement engaging at the outer periphery of the blank. Thereby the counter-force can either be applied on the clamping arrangement and transferred from the latter to the blank or the counter-force can be generated by the frictional force exerted by the clamping arrangement on the blank.

The axial pressing force and the counter-force acting against the latter are preferably rated such that, as a result of the superimposition of a compressive stress, a stress state is achieved in the disc which at least compensates for the shearing and tensile stresses in the disc acting during the penetration. Thus, fractures, burrs and such deformations at the peripheral edge of the produced through-hole are avoided in the optimum manner.

According to another embodiment of the method according to the invention, the disc core is not completely ejected from the disc, but preferably only up to approx. 98-99% of its height or of the thickness of the disc. Subsequently the blank with the disc core in one piece therewith is then withdrawn axially whilst maintaining the aforementioned axial pressing force on the disc located in the die, i.e. is moved away axially from the disc located in the die, until such time as the disc core is severed from the remaining part of the disc ring. Even by this measure the formation of undesired deformations at the inner edge of the moulded part is avoided and, moreover, it prevents the punch from striking against the inner edge of the die. According to a likewise advantageous, alternative variant of embodiment, the blank is held fast and the die with the disc located therein is moved away from the blank.

With the method described in aforementioned DE 31 47 897 A1, the blank is held between two swages, which produce the advancing movement of the blank and the compression thereof. The length of the blank and the number of moulded parts that can be produced with a blank is therefore limited and the unused remaining parts of the blanks are lost as waste. According to a further advantageous embodiment of the method according to the invention, this problem is avoided by the fact that a clamping arrangement, which engages at the periphery of the blank, is used to support the blank and for its lengthwise fixing during the reshaping step and preferably also during the penetration step and during the severing step. This clamping arrangement can for example be disposed in the advancing direction shortly before the guide. In this way, the length of the blanks is not limited by a second swage, so that long rods or almost endless blank material, which for example is available wound up on reels, can also be processed and, accordingly, virtually no significant waste occurs any more.

According to a further advantageous embodiment of the method according to the invention, the blank is produced in a reducing step by cross-sectional narrowing from a rod material having larger cross-sectional dimensions. This means that, as a starting material, use is made of a rod material which has larger cross-sectional dimensions than the blank required for the production of the moulded parts, and this rod material is narrowed to the cross-sectional dimensions required for the blank, i.e. the moulded parts to be produced therefrom. The narrowing can take place for example in a manner known per se by means of an upstream reducing die, through which the rod material is pressed and/or drawn during the advancing movement of the blank in the advancing step or in an upstream reshaping step. The dimensions of the rod material do not therefore have to coincide with those of the blank and moulded parts having different dimensions can be produced with one and the same rod material. Amongst other things, the procurement and storage of the rod material is thus considerably simplified.

A device suitable for carrying out the method according to an embodiment of the invention comprises a guide for a blank, a die, a mobile swage with a punch for the axial compression and reshaping of an end region of the blank, advancing means for the blank and holding means for the blank. According to an embodiment of the invention, the swage comprises a sleeve-shaped hold-down element mobile relative to the punch and surrounding the punch, by means of which hold-down element a disc located in the die can be subjected to an axial pressing force, wherein the external contour of the hold-down element essentially corresponds to the internal contour of the die, and the holding means comprise a clamping arrangement engaging at the periphery of the blank, said clamping arrangement being designed separate from the guide and the die and for introducing an axial counter-force into the blank. By means of the clamping arrangement, moreover, the processing of comparatively very long or almost endless rod material is possible.

According to an advantageous embodiment, the clamping arrangement being designed separate from the guide and the die and preferably can be adjusted in the longitudinal direction of the blank.

According to a further advantageous embodiment, the device comprises a cross-section reducing arrangement for shaping the blank from a rod material having larger cross-sectional dimensions. The latter enables the production of differently dimensioned moulded parts from a limited set of different rod materials.

The method according to thean embodiment of the invention and the device according to an embodiment of the invention can be used in cold forming through to hot forming over the whole temperature range.

BRIEF DESCRIPTION OF THE DRAWINGS

The method according to an embodiment of the invention and the device according to an embodiment of the invention are described below in greater detail on the basis of two examples of embodiment making reference to the appended drawings. In the figures.

DETAILED DESCRIPTION OF THE INVENTION

Figure 1:
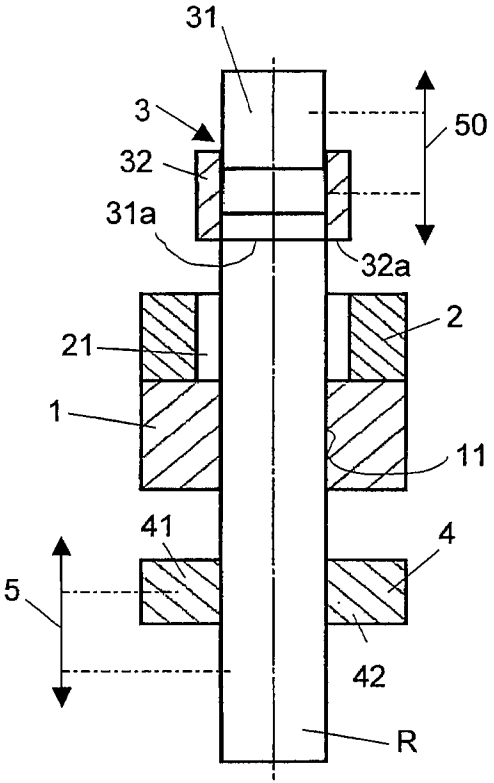
FIG. 1-6—show the main parts of a first example of embodiment of the device according to the invention in six typical process phases.

The following embodiments describe, merely by way of example, the production of flat, circular moulded parts, wherein use is made of rod material or blanks with a circular cross-section.

FIGS. 1-6 illustrate a first example of embodiment of the invention, wherein only the parts of the device essential to the understanding of the invention are represented. One sees a guide 1, a die 2 disposed above the latter, a swage 3 and a clamping arrangement 4 and advancing means 5 and 50 respectively, symbolised solely by an arrow, for a rod-shaped blank R with a circular cross-section, for clamping arrangement 4 and for swage 3. Guide 1, die 2, swage 3 and clamping arrangement 4 are aligned coaxially with respect to one another. Swage 3 comprises a punch 31 and an essentially sleeve-shaped or annular hold-down element 32 surrounding the latter. Guide 1 and die 2 are stationary, whereas swage 3 and clamping arrangement 4 are disposed axially mobile. Guide 1, die 2, swage 3, clamping arrangement 4 and advancing means 5, 50 are parts of a reshaping machine, which comprises in a manner known per se drive means for implementing the movement sequences of the aforementioned device parts yet to be described and for generating the required forces. The person skilled in the art does not need any further explanation in this regard.

The stationary guide 1 comprises a through-going guide opening 11, cylindrical in the example here, with essentially the same cross-sectional shape as blank R to be used. Die 2 which is likewise stationary comprises a cylindrical inner space 21, the diameter whereof is greater than the diameter of blank R and of guide opening 11. Punch 31 of swage 3 is constituted cylindrical and essentially has the same cross-sectional shape as blank R. Hold-down element 32 of swage 3 has the shape of a cylindrical pipe, wherein its outer diameter essentially corresponds to the inner diameter of die 2. Punch 31 and hold-down element 32 comprise here flat end faces 31*a* and 32*a* respectively. Clamping arrangement 4 comprises for example two opposite-lying clamping jaws 41 and 42 which are adapted to the external shape of blank R.

The method according to the invention proceeds in a repetitive cycle. In an advancing step, blank R is advanced in its longitudinal direction by means of clamping arrangement 4 provided with an advancing means 5 through guide 1 and die 2 until such time as the required material volume for the reshaping is available. Punch 31 is then advanced until its end face 31*a* reaches the position for the start of reshaping shown in FIG. 1. The section of the blank extending from guide 1 up to swage 3 is denoted below as the end region.

Figure 2:
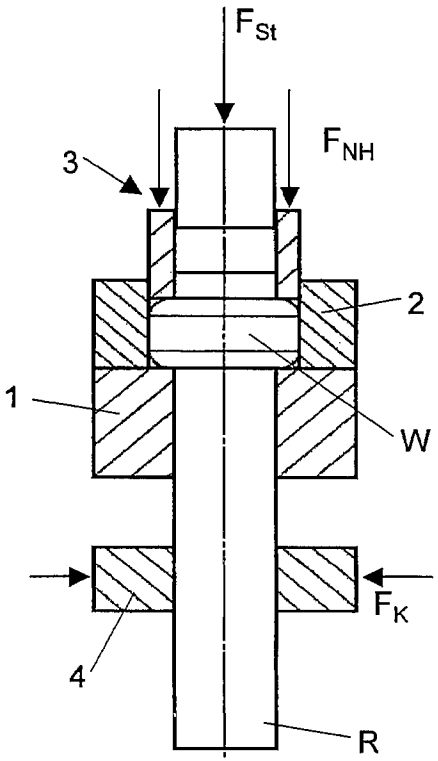
Figure 3:
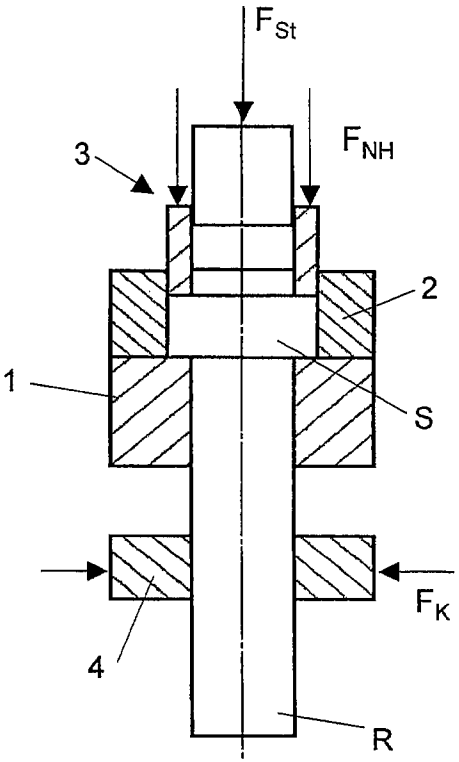
Figure 6:
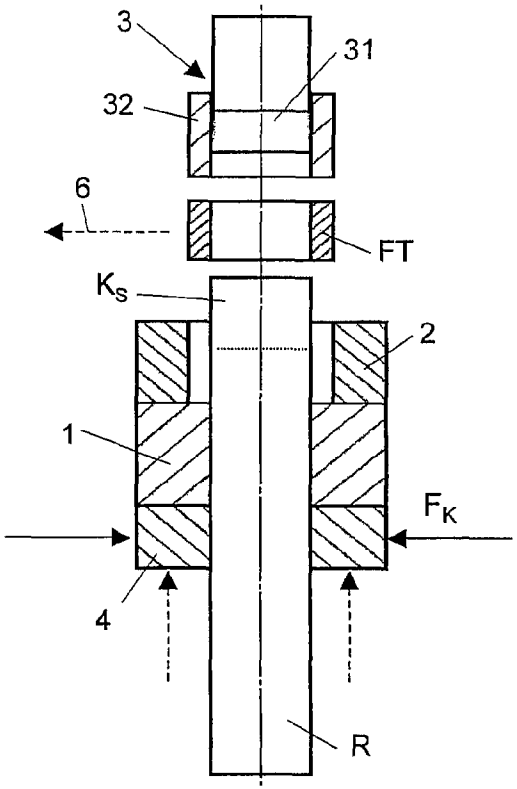
Figure 5:
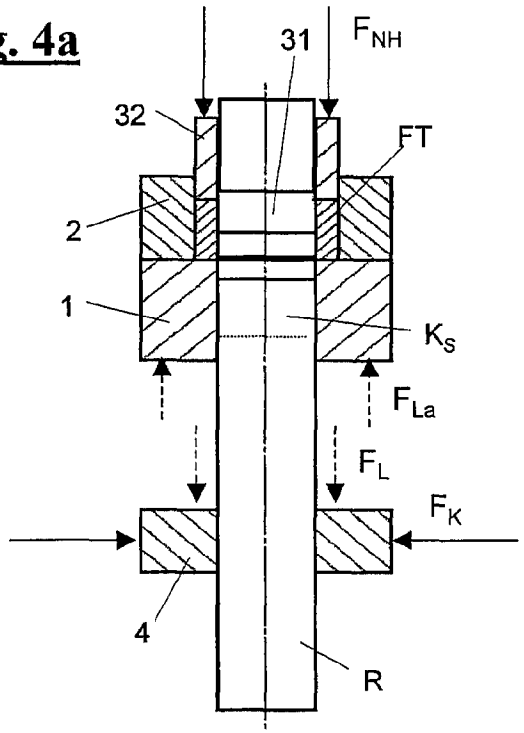

In the subsequent reshaping step, clamping arrangement 4 subjected to a clamping force $F_K$ is held stationary and blank R is fixed axially. Swage 3 as a whole is then pressed axially towards the end region of blank R, wherein punch 31 and hold-down element 32 are subjected respectively to a punching force $F_{St}$ and a hold-down force $F_{NH}$. As a result of the advancing motion of swage 3, the end region of the blank is compressed and reshaped into the die, a bulge-like deformation W first arising, which in particular does not yet fill out the corner regions of die 2 (FIG. 2). As a result of further axial advancing of swage 3, bulge-like deformation W is reshaped into a disc S, which fills die 2 and exhibits the final external shape of the moulded part to be produced (FIG. 3).

Figure 4A:
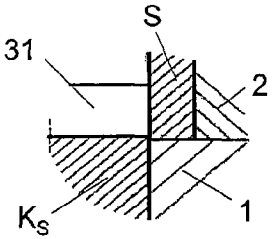
FIG. 4*a*—shows a detail A from FIG. 4 in an enlarged representation.
Figure 4:
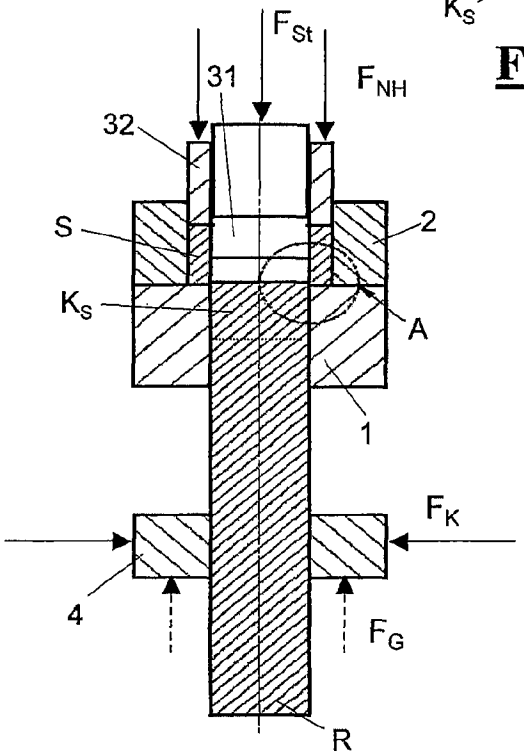
Figure 9:
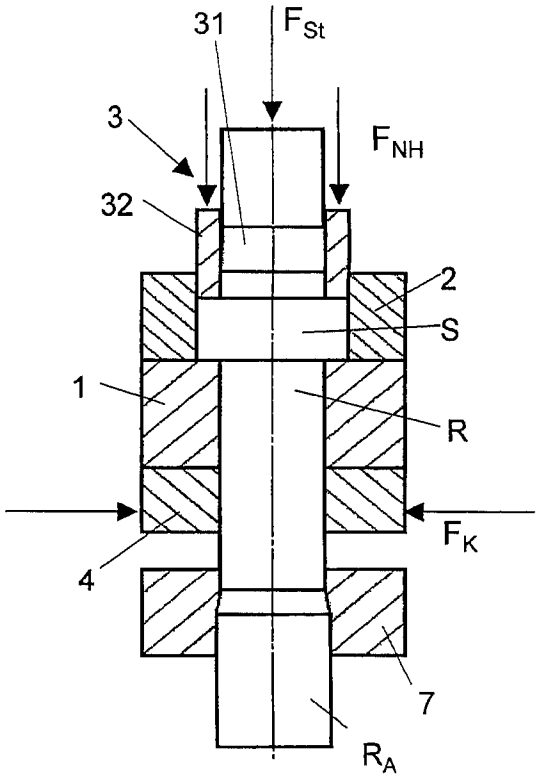
FIG. 7-12—show the main parts of a second example of embodiment of the device according to the invention in six typical process phases.
Figure 8:
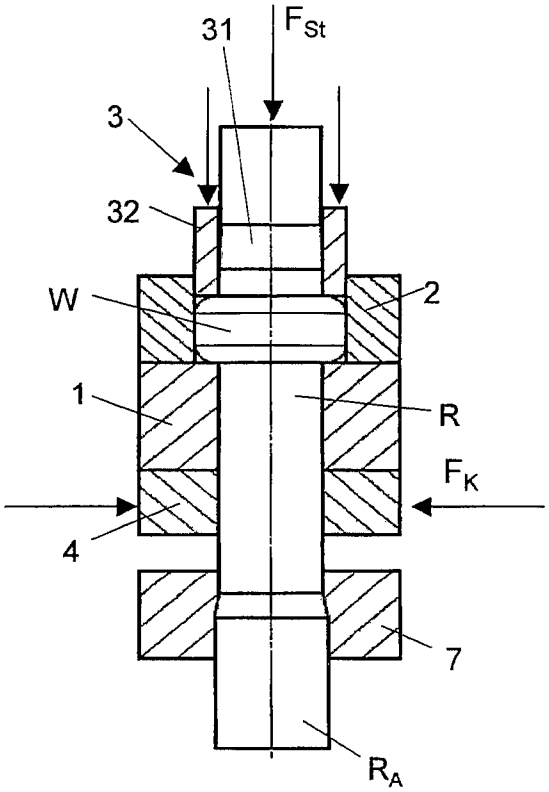
Figure 7:
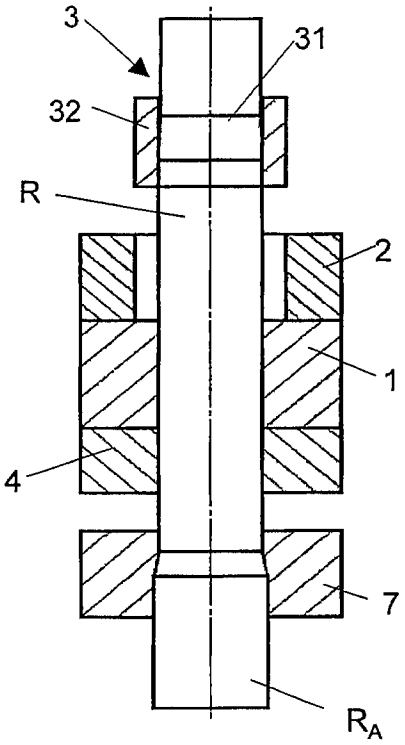
Figure 12:
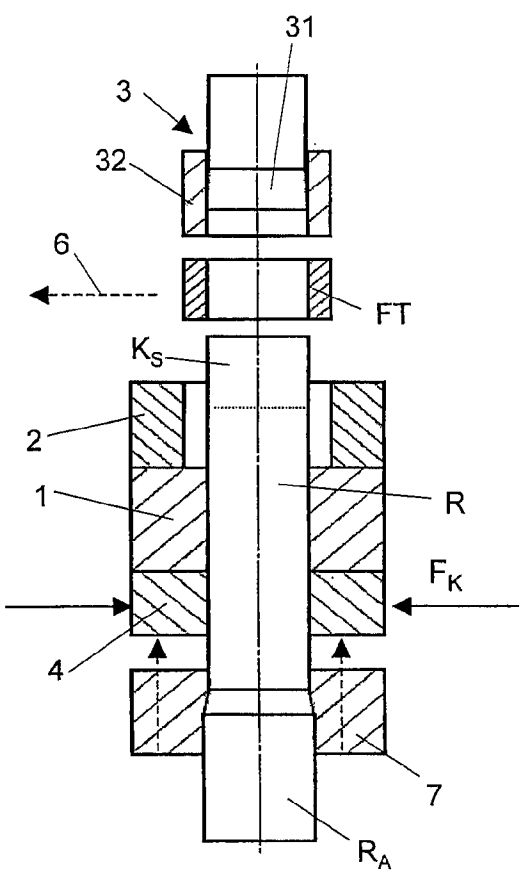
Figure 11:
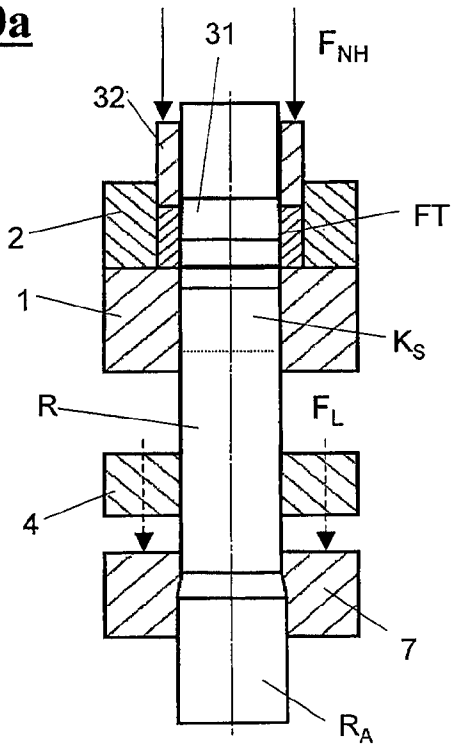
Figure 10A:
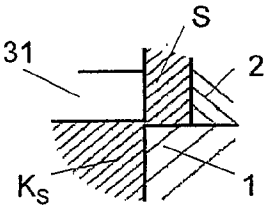
FIG. 10*a*—shows a detail B from FIG. 10 in an enlarged representation.
Figure 10:
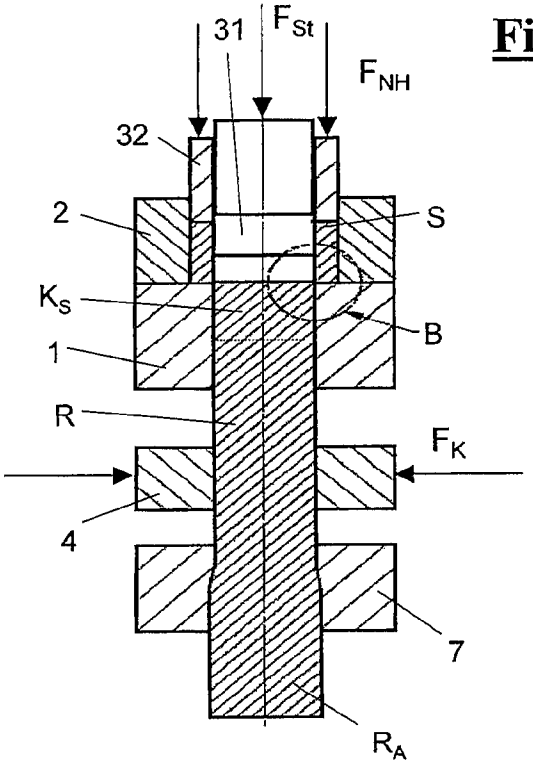

The external shape of the moulded part to be produced is already reached after these two process steps. A penetration step follows, in which the central annular opening of the moulded part to be produced is generated. For this purpose, (only) punch 31 of swage 3 is pressed axially through disc S by applying thereto an axial punching force $F_{st}$. Blank R still held in clamping arrangement 4 together with the latter is moved away from guide 1 against a defined counter-force $F_G$ acting axially on clamping arrangement 4. In this way, a disc core $K_S$ in one piece with the blank is ejected by punch 31 out of disc S and pushed into guide 1 (FIG. 4). During this step, hold-down element 32 holds fast disc S located in die 2 and subjects the latter to an axial pressing force $F_{NH}$. At the same time, described counter-force $F_G$ acts axially on the blank and disc S. Axial pressing force $F_{NH}$ and axial counter-force $F_G$ generate a compressive stress in disc S, which superimposes and compensates or even over-compensates shearing and tensile stresses occurring during the penetration of the disc. The described penetration process is ended before disc core $K_S$ is completely punctured. In practice, this means that disc core $K_S$ is punctured up to approximately 98-99%, i.e. it still lies inside disc S with approximately 1-2% of its height, which corresponds to the thickness of disc S. The enlarged detail representation of FIG. 4*a* illustrates this.

A severing step next follows. During this step, too, hold-down element 32 holds fast disc S located in die 2 and subjects the latter to an axial pressing force $F_{NH}$. In this step, blank R, which continues to be held fast in clamping arrangement 4, is moved away, together with clamping arrangement 4, under the effect of a releasing force $F_L$, against the advancing direction of the blank by a short path from stationary guide 1 and stationary die 2, i.e. downwards in FIG. 5. Disc core $K_S$ in one piece with the blank is thereby severed from disc S, as a result of which disc S now has a central through-hole and the thus finished moulded part has the desired shape. As a result of subjecting disc S held fast in the die to axial pressing force $F_{NH}$ via hold-down element 32, with suitable rating of axial pressing force $F_{NH}$ and counter-force $F_G$, the shearing and tensile stresses occurring during the penetration of the disc and during the severing of disc core $K_S$ are compensated or over-compensated by the superimposition of a compressive stress and, therefore, the formation of fractures, burrs or other deformations at the peripheral edge of the produced through-hole in the disc is prevented.

The counter-force $F_G$ acting on the blank can according to an alternative variant of the method, also be generated by friction. Clamping arrangement 4 is held stationary and clamping force $F_K$ is adjusted somewhat lower such that blank R can move through clamping arrangement 4 against the frictional resistance generated by the clamping effect. The frictional resistance corresponds to the aforementioned counter-force.

The severing step can according to a further variant of the method, also be carried out in such a way that it is not the blank that is moved away from the die, but rather blank R is held fast in clamping arrangement 4 and die 2 with disc S located therein, optionally together with guide 1, is moved away from the blank. The releasing force thereby required acting on die 2 and guide 1 is symbolised by arrow $F_{La}$ in FIG. 5.

The finished moulded part located in die 2 after these process steps is denoted by FT and is removed from the device in a removal step, wherein this preferably takes place by ejection of moulded part FT using an ejector not represented here. For this purpose, swage 3 is traversed into the position shown in FIG. 6 and at the same time punch 31 is retracted into hold-down element 32 until its end faces again lie in a plane. A gripping device 6 symbolised solely by an arrow grips finished moulded part FT and conveys it for example to a receiving container (not represented) or to a further processing station. Swage 3 and clamping arrangement 4 are then brought back into their initial positions represented in FIG. 1, and a further process cycle can begin.

The FIGS. 7-12 illustrate the second example of embodiment of the invention, which differs from the example of embodiment according to FIGS. 1-6 essentially only in the fact that, in the advancing direction of blank R before clamping arrangement 4, there is disposed coaxial with the latter a cross-section reducing arrangement in the form of a reducing die 7. Reducing die 7 is disposed at a fixed distance from the clamping arrangement and can be moved jointly with the latter.

In the case of this variant of the method, a rod material $R_A$ is used as a starting material, which has greater cross-sectional dimensions than actual blank R required for the production of the moulded part, and actual blank R is aimed from this thicker rod material $R_A$ in a reducing step. In other words, the cross-sectional dimensions of blank R are reduced to the desired or required size before reaching clamping arrangement 4 and guide 1. This cross-sectional or thickness narrowing is advantageously carried out as part of the advancing step of the method, but can also take place in an upstream step. As a result of the cross-sectional narrowing in the course of the rest of the process sequence, the dimensions of the rod material do not have to coincide with those of the blank and moulded parts having different dimensions can be produced with one and the same rod material.

All the remaining parts of the device shown in FIGS. 7-12 correspond wholly to the device of FIGS. 1-6, identical parts being denoted by identical reference numbers. With the exception of the additional reducing or narrowing step, all the process steps and movement sequences are the same as in the example of embodiment of FIGS. 1-6, so that there is no need for a more detailed explanation. Furthermore, the method variants explained in connection with the first example of embodiment also apply analogously to the example of embodiment according to FIGS. 7-12.

The invention claimed is:

1. A method for producing a finished moulded part provided with a through-hole, comprising an advancing step wherein a rod-shaped blank is advanced by a defined length in its longitudinal direction through a guide having a same cross-sectional shape as the blank and into a die, an inner peripheral wall of the die establishing an outer periphery of the finished moulded part to be produced, holding fast, in at least one reshaping step, the blank, wherein an end region of the blank located outside the guide is axially compressed by a swage and thereby reshaped to form a disc limited at an outer periphery by the die, wherein in a penetration step the disc located in the die is penetrated by a punch coaxial with the guide and applying an axial punching force ($F_{St}$) to the disc, the punch having substantially the same cross-sectional shape as the guide, wherein a disc core in one piece with an undeformed part of the blank and having substantially the same cross-sectional shape is ejected from the disc, pushed into the guide and, together with the undeformed part of the blank located in the guide, moved back opposite to the advancing direction of the blank and against an axial counter-force ($F_G$) introduced into the blank, wherein in a severing step the disc is severed from the disc core, wherein in a removal step the finished moulded part is removed from the die, wherein during the penetration step the disc located in the die is subjected to an axial pressing force ($F_{NH}$) by a sleeve-shaped hold-down element of the swage, which holds the disc stationary in the die and against the axial counter-force ($F_G$), and wherein the external contour of the hold-down element substantially corresponds to an internal contour of the die.

2. The method according to claim 1, wherein during the severing step the blank located in the die is subjected to the axial pressing force in the disc core ejection direction.

3. The method according to claim 2, wherein the axial pressing force and the axial counter-force are selected with a magnitude such that there is generated in the disc a stress state which at least compensates for tensile and shearing stresses occurring in the disc.

4. The method according to claim 1, wherein in the penetration step the disc core is not completely ejected from the disc, but only approximately up to 98-99% of its thickness.

5. The method according to claim 1, wherein in the severing step a remainder of the blank together with the disc core in one piece with the latter is moved away axially from the disc held stationary in the die, so that the disc core is severed from the disc.

6. The method according to claim 1, wherein in the severing step the die with the disc located therein is moved away axially from a remainder of the blank held stationary and the disc core in one piece with the latter, so that the disc core is severed from the disc.

7. The method according to claim 1, wherein the blank is held fast during the reshaping step, the penetration step and the severing step by a clamping arrangement engaging its periphery.

8. The method according to claim 7, wherein the axial counter-force acts on the clamping arrangement and is introduced via the latter into the blank.

9. A method for producing a finished moulded part provided with a through-hole, comprising an advancing step wherein a rod-shaped blank is advanced by a defined length in its longitudinal direction through a guide having a same cross-sectional shape as the blank and into a die, an inner peripheral wall of the die establishing an outer periphery of the finished moulded part to be produced, holding fast, in at least one reshaping step, the blank, wherein an end region of the blank located outside the guide is axially compressed by a swage and thereby reshaped to form a disc limited at an outer periphery by the die, wherein in a penetration step the disc located in the die is penetrated by a punch coaxial with the guide and applying an axial punching force ($F_{st}$) to the disc, the punch having substantially the same cross-sectional shape as the guide, wherein a disc core in one piece with an undeformed part of the blank and having substantially the same cross-sectional shape is ejected from the disc, pushed into the guide and, together with the undeformed part of the blank located in the guide, moved back opposite to the advancing direction of the blank and against an axial counter-force ($F_G$) introduced into the blank, wherein in a severing step the disc is severed from the disc core, and wherein in a removal step the finished moulded part is removed from the die, wherein during the penetration step the disc located in the die is subjected to an axial pressing force ($F_{NH}$) by a sleeve-shaped hold-down element of the swage, which holds the disc stationary in the die and against the axial counter-force ($F_G$), wherein the external contour of the hold-down element substantially corresponds to an internal contour of the die, wherein the blank is held fast during the reshaping step, the penetration step and the severing step by a clamping arrangement engaging at its periphery, and wherein the blank is produced in a reducing step by cross-sectional narrowing from a rod material having a larger cross-sectional dimension.

10. A method for producing a finished moulded part provided with a through-hole, comprising an advancing step wherein a rod-shaped blank is advanced by a defined length in its longitudinal direction through a guide having a same cross-sectional shape as the blank and into a die, an inner peripheral wall of the die establishing an outer periphery of the finished moulded part to be produced, holding fast, in at least one reshaping step, the blank, wherein an end region of the blank located outside the guide is axially compressed by a swage and thereby reshaped to form a disc limited at an outer periphery by the die, wherein in a penetration step the disc located in the die is penetrated by a punch coaxial with the guide and applying an axial punching force $F_{st}$ to the disc, the punch having substantially the same cross-sectional shape as the guide, wherein a disc core in one piece with an undeformed part of the blank and having substantially the same cross-sectional shape is ejected from the disc, pushed into the guide and, together with the undeformed part of the blank located in the guide, moved back opposite to the advancing direction of the blank and against an axial counter-force ($F_G$) introduced into the blank, wherein in a severing step the disc is severed from the disc core, and wherein in a removal step the finished moulded part is removed from the die, wherein during the penetration step the disc located in the die is subjected to an axial pressing force ($F_{NH}$) by a sleeve-shaped hold-down element of the swage, which holds the disc stationary in the die and against the axial counter-force ($F_G$), wherein the external contour of the hold-down element substantially corresponds to an internal contour of the die, wherein the blank is produced in a reducing step by cross-sectional narrowing from a rod material having a larger cross-sectional dimension, and wherein the reducing step takes place during the advancing step.

11. The method according to claim 1, wherein the sleeve-shaped hold-down element is mobile relative to the punch and surrounds the punch.

12. The method according to claim 7, wherein the axial counter-force is generated by a frictional force exerted by the clamping arrangement on the blank.

13. The method according to claim 1, wherein the blank is held within the die and restrained by the inner peripheral wall of the die as the blank is formed into the finished moulded part.

* * * * *